US005873201A

United States Patent [19]

Fey

[11] Patent Number: 5,873,201

[45] Date of Patent: Feb. 23, 1999

[54] ROOF STRUCTURE SUPPORT DEVICE

[75] Inventor: James Fey, Redondo Beach, Calif.

[73] Assignee: Lonnie Naefke, Redondo Beach, Calif.

[21] Appl. No.: 956,310

[22] Filed: Oct. 22, 1997

[51] Int. Cl.[6] ..... E04F 19/00; E04B 1/38

[52] U.S. Cl. ..... 52/27; 52/704; 248/237

[58] Field of Search ..... 52/27, 712, 713, 52/710, 698, 704; 248/237

[56] References Cited

U.S. PATENT DOCUMENTS

| | | | |
|---|---|---|---|
| 2,895,704 | 7/1959 | Urbain et al. | 52/27 |
| 4,226,058 | 10/1980 | Riley | 52/27 |
| 5,456,433 | 10/1995 | Burns | 52/27 |

FOREIGN PATENT DOCUMENTS

| | | | |
|---|---|---|---|
| 0212228 | 3/1987 | United Kingdom | 52/698 |

*Primary Examiner*—Carl D. Friedman
*Assistant Examiner*—Dennis L. Dorsey
*Attorney, Agent, or Firm*—Theodore J. Bielen, Jr.

[57] ABSTRACT

A device for supported by roof structure utilizing a platform having first and second surfaces the second surface bears on the roof. The platform includes a slot between the first and second surfaces which accepts a slidable element. An element is formed with a flange and extending legs which form a chamber within the slot of the platform. The flange portion of the element is provided with an opening to accept a fastener which extends through the chamber into the roof. A filler material occupies the chamber and protects the fastener within the chamber.

12 Claims, 3 Drawing Sheets

38
10
20
64
18
12
28
42
24
60
30
39
36
34
32
56
7
26
62
40
66
58
44
54
68
4
22
52
14
16

ROOF STRUCTURE SUPPORT DEVICE

BACKGROUND OF THE INVENTION

The present invention relates to a novel roof structure support device.

Many electronic devices are mounted on rooftops of buildings, such as commercial structures. For example, microwave antennas, communication towers, cellular phone antennas, and the like are commonly mounted on rooftops. Moreover, it is important that virtually all of these apparatuses be fenced or screened for safety and/or aesthetic reasons.

The mounting of any structure to a rooftop inherently involves penetrating the membrane of the roof. Of course, care must be taken to maintain the water tight integrity of a roof membrane when such structures are mounted to the roof.

In the past, items have been erected on rooftops followed by construction of a berm or build-up of roof-like material around the fasteners which have penetrated the roof. It has been found that this system of maintaining the watertight integrity of a roof membrane is expensive and tends to be unreliable over a period of time, since the berm filled with pitch-like material erodes under the influence of weather elements such as rain, ice, ultra-violet light, and the like.

A system for mounting roof supported structures which protects the roof membrane would be a notable advance in the construction and communication fields.

SUMMARY OF THE INVENTION

In accordance with the present invention a novel and useful roof structure support device is herein provided.

The device of the present invention utilizes a platform which includes a first surface and a second surface that bears on the roof itself. The platform possesses at least one slot between the first and second surfaces. In certain cases, the platform includes a plurality of slots similarly constructed.

An element is also found in the present invention and is movable along the slot of the platform. The element is formed with a flange portion that bears on the platform and a protuberance or extending portion which protracts from the flange into the slot of the platform. The extending portion forms a chamber in cooperation with the platform slot in this regard. An opening is also provided through the flange to communicate with the chamber formed by the portion extending from the flange.

Fastening means is also employed in the present invention and may be in the form of an elongated fastener such as a lag screw, or bolt. The fastener passes through the opening of the flange through the chamber formed by the extending portion of the element, and into engagement with roof structure such as a joist or beam, after passing through the roof membrane. A filler material, compatible with the roof membrane, is placed in the chamber of the element to completely surround the fastener and to isolate the opening of the roof membrane from contact with water and the like.

The platform is also formed with a member adjacent to the slot or slots. Such member is defined to include support means for an upright structure, such as a post, which may be employed to support a screen or fence. Of course, other items may be supported to the device of the present invention in this regard. Further, the member portion of the platform is provided with a passage between the roof and the second surface of the platform to prevent buildup of water at this part of the platform. Moreover, the chamber formed by the slot and element of the platform is also provided with a weep opening for the same purpose.

In addition, the filler placed in the chamber formed by the extending portion of the flange and the slot of the platform may be enclosed in a container that is breakable. That is to say, a flexible plastic or paper bag may be used to hold the filler material temporarily until the fastener is fixed to the roof structure. At that point, the container would be broken either by the fastener, or by the operator, such that the filler material completely fills the chamber. In certain cases, the filler material may also flow from the chamber to a degree for the purpose of isolating the fastener within the chamber of the element.

It may be apparent that a novel and useful support device for a roof structure has been described.

It is therefore an object of the present invention to provide a roof structure support device which may be positioned on a roof and be fastened to the same without interrupting the protective membrane of the roof structure.

Another object of the present invention is to provide a roof structure support device which is fastenable to a roof membrane without interrupting that membrane and is capable of supporting upright structure such as a post or pole.

Yet another object of the present invention is to provide a roof structure support device which is capable of serving as a portion of a fence or screen which essentially surrounds the source of electromagnetic radiation.

Another object of the present invention is to provide a roof structure support device which permits the safe installation of a source of electromagnetic radiation on a roof top.

The invention possesses other objects and advantages especially as concerns particular characteristics and features thereof which will become apparent as the specification continues.

For a better understanding of the invention references made to the following detailed description of the preferred embodiments thereof which should be referenced to the hereinabove described drawings.

DETAILED DESCRIPTION OF THE PREFERRED EMBODIMENTS

Various aspects of the present invention will evolve from the following detailed description of the preferred embodiments thereof which should be referenced to the prior described drawings.

Figures 1, 2:
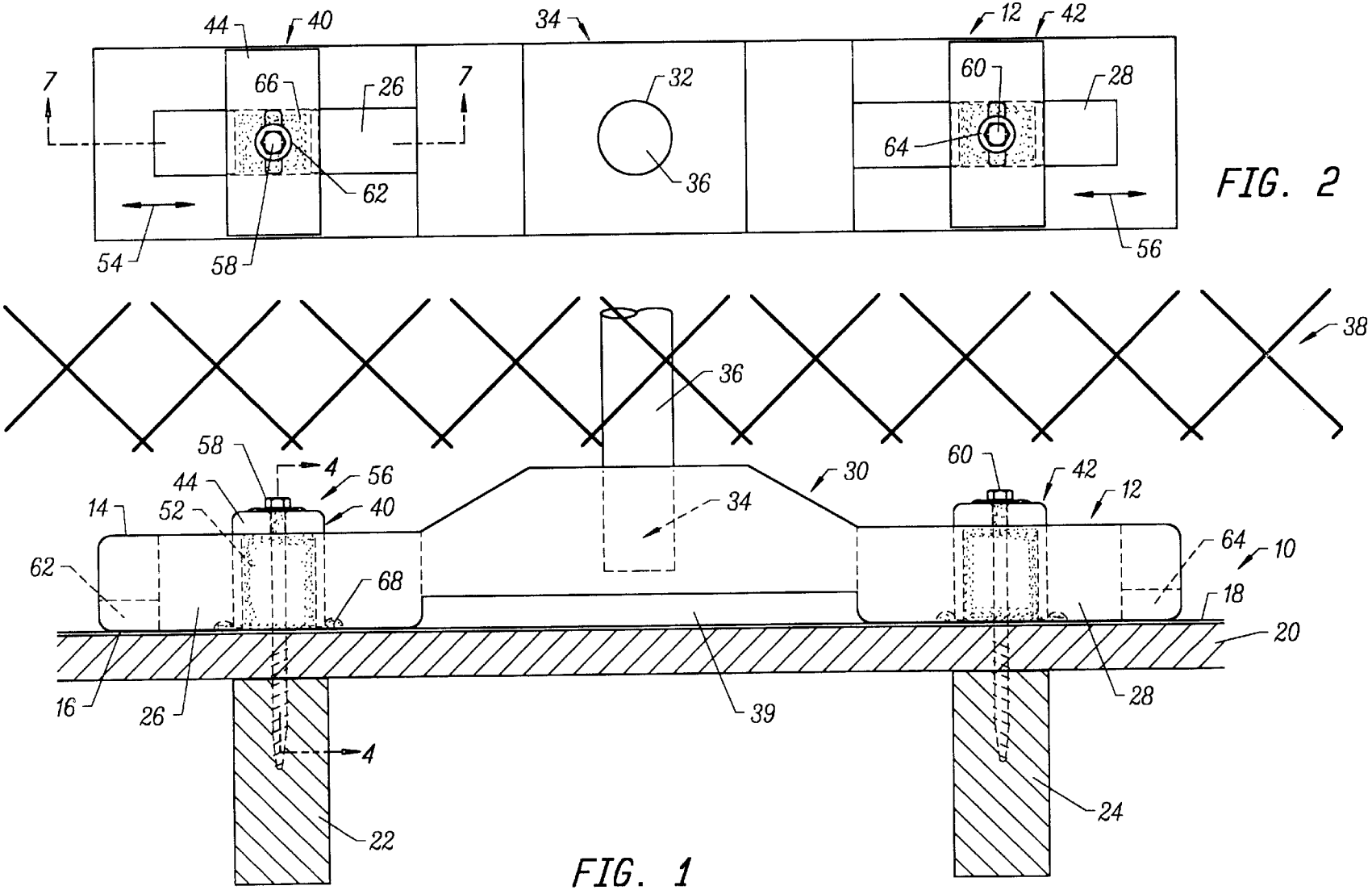
FIG. 1 is a side elevational view of the present invention in place on a roof structure.
FIG. 2 is a top plan view of the device of the present invention.
Figure 3:
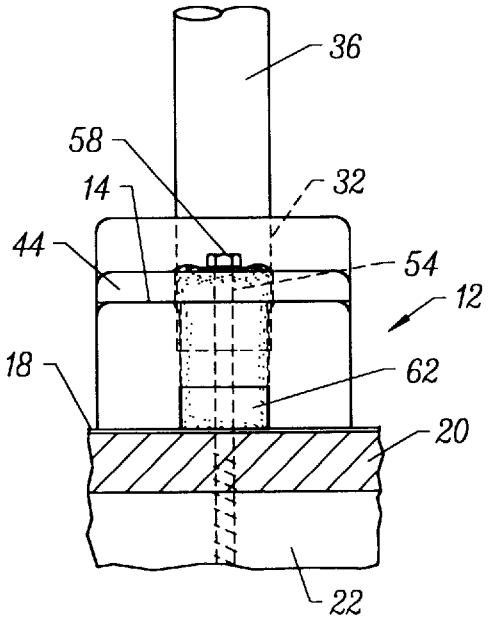
FIG. 3 is an end elevational view of the device depicted in FIG. 2 with the roof structure in section.
Figure 4:
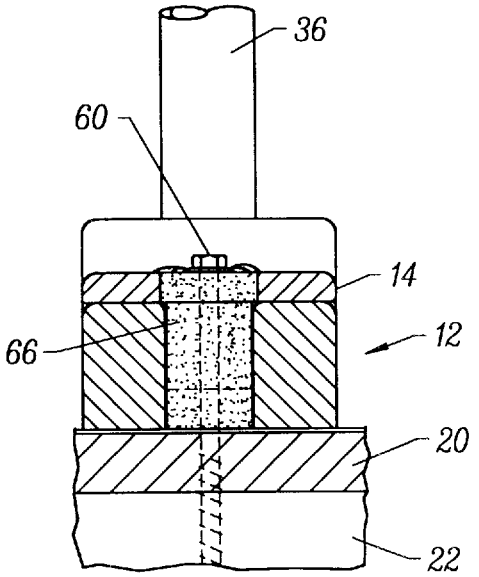
FIG. 4 is a sectional view taken along line 4—4 of FIG. 1.

The invention as a whole is depicted in the drawings by reference character 10. The roof structure support device 10 includes as one of its elements a platform 12 having a top first surface 14 and a lower second surface 16. Surface 16 is intended to bear on surface 18 of roof structure 20. Roof structure 20 also is depicted in FIG. 1 as including joists 22 and 24. Platform 12 is also provided with slots 26 and 28, FIGS. 1 and 2, which extend from first upper surface 14 of platform 12 to second lower surface 16, thereof. Bridging member 30 lies between slots 26 and 28. Bridging member 30 includes an aperture or opening 32 which serves as support means 34 for post or pole 36, which is depicted as holding a fence 38. Passage 39 extends across platform 12 to allow water, debris, and other items to flow therethrough.

Figure 5:
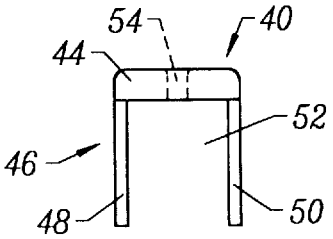
FIG. 5 is a side elevational view of the slot engaging element of the present invention.
Figure 6:
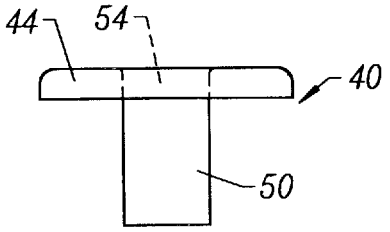
FIG. 6 is a front elevational view of the slot engaging element of the present invention.

The device 10 of the present invention is also provided with elements 40 and 42 which interact with slots 26 and 28, respectively. Element 40 is shown in an exemplary fashion in FIGS. 5 and 6, since it is similarly constructed to element 42. Element 40 includes a flange portion 44 and a portion 46 which extends therefrom. Extending portion 46 is defined in the embodiment shown in the drawings as legs 48 and 50. Legs 48 and 50 interact with platform 12, specifically slot 26, to form a chamber 52. It should be noted that elements 40 and 42 move along slots 26 and 28 as desired according to directional arrows 54 and 56. Flange 44 is also provided with an opening 54 which may be slot-shaped as shown in the drawings or simply an opening of circular configuration.

Fastening means 56 is also depicted in the drawings. Fastening means 56 is illustrated as lag screws 58 and 60 which are used in conjunction with washers 62 and 64, respectively, best shown in FIG. 2. Exemplary lag screw 58, used in conjunction with element 40 extends through flange 44 chamber 52, roof surface 18, roof structure 20, and into joist 22. Lag screw 60 is similarly positioned with respect to element 42 and joist 24 shown on FIG. 1. It should be noted that slot 26 and slot 28 include apertures 62 and 64 to prevent the buildup of water within slots 26 and 28, respectively.

Figure 7:
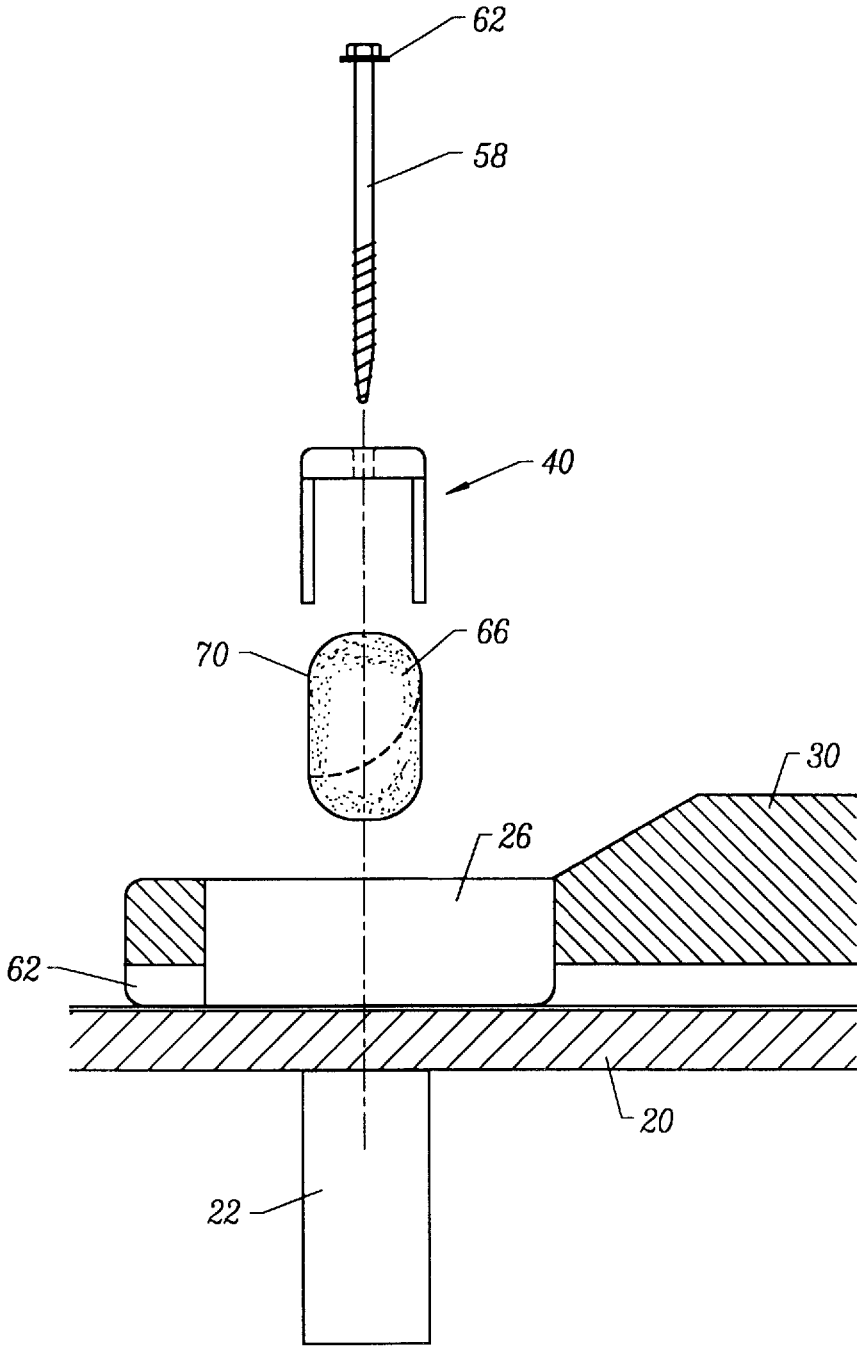
FIG. 7 is an exploded view depicting the assembly of the slot engaging element with the platform portion of the present invention.

Filler 66, which may be in the form of a flowable organic material compatible with roof membrane 18, is placed within exemplary chamber 52 of element 40 formed by element 40 and slot 26 of platform 12. Of course, a similar filler is used in conjunction with element 42. Filler 66 is intended to completely occupy chamber 52 and may flow therefrom as depicted in FIG. 1 by bead 68. Turning to FIG. 7, it may be observed that filler 66 has been placed in a breakable container 70 which remains in chamber 52 after such container 70 is opened. The breaking of container 70 may take place by simple use of lag screw 62 or by a separate step.

In operation, the user places platform 12 on roof surface 18. Elements 40 and 42 are moved along slots 26 and 28 in order to center the same of joists 22 and 24 or other pertinent structural members usually found beneath roof structure 20. Exemplary chamber 52 and a similar chamber formed by element 42, are filled with filler 66. Fastening means 56 is then employed in the form of fastener screws 58 and 60 to hold platform 12 to roof structure 20 as illustrated in FIG. 1. Filler 66 then completely fills chamber 52 and may flow therefrom as indicated by bead 68. Apertures 62 and 64 permit the passage of water from slots 26 and 28 when lag screws 58 and 60 have been employed. Bridging member 30 and support means 54 are then employed to hold a structure such as post 36 in an upright position.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device supported by a roof structure, comprising:

a. a platform, said platform having a first surface and a second surface bearing on the roof structure, said platform including a slot between said first and second surfaces;

b. an element movable along said slot of said platform, said element having a flange portion bearing on said platform, said flange further comprising a portion extending from said flange into said slot of said platform, said portion forming a chamber in cooperation with said platform slot said flange including an opening communicating with said chamber;

c. fastening means extending through said opening in said flange, through said chamber and into engagement with the roof structure; and d. a filler for occupying said chamber.

2. The device of claim 1 in which said flange includes a surface for slidingly engaging said first surface of said platform.

3. The device of claim 1 in which said fastener is a screw.

4. The device of claim 1 in which said platform additionally comprises a member adjacent said slot, said member including support means for an upright member.

5. The device of claim 4 in which said member further comprises a passage between the roof structure and said second surface of said platform.

6. The device of claim 1 in which said chamber formed by said element said slot of said platform further includes an aperture communicating with the roof.

7. The device of claim 6 in which said platform additionally comprises a member adjacent said slot, said member including support means for an upright member.

8. The device of claim 7 in which said member further comprises a passage between the roof structure and said second surface of said platform.

9. The device of claim 8 which additionally comprises a breakable container for said filler.

10. The device of claim 9 in which said filler is a flowable material.

11. The device of claim 1 which additionally comprises a breakable container for said filler.

12. The device of claim 11 in which said filler is a flowable material.

* * * * *